United States Patent [19]

Bouvaist et al.

[11] Patent Number: 4,659,393

[45] **Date of Patent: * Apr. 21, 1987**

[54] PROCESS FOR THE THERMAL TREATMENT OF ALUMINUM ALLOY SHEETS

[75] Inventors: Jean Bouvaist; Daniel Ferton, both of Grenoble, France

[73] Assignee: Societe de Transformation de l'Aluminium Pechiney, Paris, France

[ * ] Notice: The portion of the term of this patent subsequent to Apr. 1, 1997 has been disclaimed.

[21] Appl. No.: 65,149

[22] Filed: Aug. 9, 1979

Related U.S. Application Data

[62] Division of Ser. No. 900,304, Apr. 26, 1978, Pat. No. 4,196,021.

[30] Foreign Application Priority Data

Jun. 2, 1977 [FR] France ..... 77 17476

[51] Int. Cl.[4] ..... C22F 1/04

[52] U.S. Cl. ..... 148/2; 148/12.7 A; 148/417

[58] Field of Search ..... 148/2, 11.5 A, 32, 12.7 A, 148/32.5

[56] References Cited

U.S. PATENT DOCUMENTS 3,791,880 2/1974 Hunsicker et al. ..... 148/11.5 A 4,196,021 4/1980 Bouvaist et al. ..... 148/11.5 A X

*Primary Examiner*—R. Dean

*Attorney, Agent, or Firm*—Dennison, Meserole, Pollack & Scheiner

[57] ABSTRACT

The invention relates to a process for the thermal treatment of aluminum alloys containing zinc, magnesium and copper as main alloying elements, and the products manufactured by this process and having an average particle diameter of Al—Mg—Cr phase of between 800 Å and 1000 Å. This process involves carrying out a treatment at high temperature for a sufficiently short period to prevent coalescense into particles which are too large. This treatment is preferably carried out at the homogenization stage for thin products and at the final dissolution stage for thick products. The invention is applied, in particular, to the manufacture of thin or thick sheets for the aeronautical industry.

2 Claims, No Drawings

PROCESS FOR THE THERMAL TREATMENT OF ALUMINUM ALLOY SHEETS

This is a division of application Ser. No. 900,304, filed Apr. 26, 1978, now U.S. Pat. No. 4,196,021.

SUMMARY OF THE INVENTION

The invention relates to a process for the thermal treatment of thin or thick sheets of aluminum alloy intended for improving their toughness.

The toughness of aluminum alloys may be estimated in particular by measuring the critical factor of intensity of stress. This measurement is made in the case of thick products according to the standard ASTM E 399-74 and allows the $K_{1C}$ factor to be determined.

In the case of thin products, measurement is made by a method proposed by the ASTM, "Proposed Recommended Practice for R-Curve Determination", pages 811–825 of Part 10, of the 1975 Annual Book of ASTM Standards. The specimens have central notches (CCT), 400 mm wide. This method allows the $K_C$ factor to be determined.

The toughness of a product, that is to say, its resistance to harsh propagation of a crack, will be greater the higher the value from $K_{1C}$ to $K_C$.

French Pat. No. 2,163,281 describes a method of treating a 7475 type aluminum alloy having the following composition, by weight, for aeronautical uses:

| | |
|---|---|
| Zinc | = 5.2–6.2% |
| Magnesium | = 1.9–2.5% |
| Copper | = 1.2–2.9% |
| Chromium | = 0.18 –0.25% |
| Iron | < 0.12% |
| Silicon | < 0.10% |
| Manganese | < 0.06% |
| Titanium | < 0.06% |
| Aluminum | Balance |

The method of the patent aims to obtain high toughnesses and resistance to tearing by treatment at high temperature, these qualities being connected with the obtaining of E ($Al_{12}Mg_2Cr$) phase particles having an average size in excess of 1,400 Å.

Such treatment at high temperatures of 504° to 538° C. must be sufficiently long to obtain this average particle size. In practice, it is recommended in the patent to carry out a treatment for 6 to 48 hours on ingots or plates followed by a solution heat treatment on the plate lasting at least a quarter of an hour and, preferably, about 2 hours. It is apparently also feasible to only carry out a single treatment at 504° to 538° C. at the solution stage if a sufficiently prolonged solution heat treatment at high temperature can be tolerated for obtaining E>1,400 Å phase particles.

It has been found that it is not desirable to obtain average E phase particles sizes equal to or greater than 1,400 Å to obtain improved characteristics of toughness in such an alloy.

A large particle size may even have disadvantages, and may, for example, promote deformation during quenching. In fact, these deformations are greater, the lower the yield strength of the alloy at quenching temperatures. Now, at these temperatures, the characteristics are no longer linked to the precipitation hardening, the Guinier zones obviously having disappeared, but to the hardening by dispersed phases owing to the insoluble ones. However, this hardening is more effective the closer and the smaller the particles. The coalescence of the particles therefore leads to a reduction in the yield strength, thus, an increase in the deformation.

Furthermore, it is difficult to increase the average E phase particle size without the very large sized particles, of the order of a micron, coalescing. Now, research conducted by S. A. Levy, Reynolds Metals Company, and published by the National Technical Information Service; comparing the 7075 alloys to zirconium and chromium respectively, has shown that the former have the lower proportion of large particles, 1 to 10 microns, as well as the highest toughness.

DETAILED DESCRIPTION

According to the process of the present invention, it is not necessary either to carry out a thermal treatment at high temperature at the solution stage. It may be carried out very well only at the homogenization stage, that is to say, on foundry plates or ingots.

However, irrespective of whether treatment is carried out at the homogenization stage or the solution stage, the products obtained by the process forming the subject of the invention are characterized by an average E phase particle diameter of between 800 and 1000 Å, calculated by the method described below.

This distribution of particle diameters may also be characterized by the number of E phase particles per unit of volume: from 70 to 110 particles per $\mu^3$ (cubic micron).

In order to define the characteristics of the present invention more accurately, it is important to show how these particle diameters are measured.

Taking into consideration the small diameter of the phase E precipitates, the only possible method of evaluating their diameter is by examination of thin blades of the alloy by transmission electron microscopy. Several thin blades, generally 4, are examined in each case so as to overcome the localized nature of this type of examination. A total of 30 areas with a magnification of 20,000 are examined from among the total number of blades and this means that a total surface area of $400\mu^2$ is examined. The dimensions of the particles are then measured with the aid of a micrometric lens of 1/10 millimeter. The microscope is standardized with the aid of a standard micrometric grid and the uncertainty of magnification after standardization is less than 0.2%. All the visible particles corresponding to the E phase have been previously checked by electron microdiffraction.

To order to determine the size of equiaxed particles of irregular shape such as grains, cells or particles of precipitates, it is customary to assimilate them to spheres and then calculate the average diameter by:

$$\bar{D} = \frac{\Sigma N_j D_j}{\Sigma N_j}$$

the typical discrepancy in distribution $\sigma(D)$ and $N_V$ the total number of particles per unit of volume (according to Underwood, Quantitative Stereology, 1970, Addison-Wesley Publishing Co., New York).

In the case of non-equiaxed particles appearing in transmission electron microscopy in the form of small rods of width 1 and length L, it is assumed that their dimension in the direction normal to the plane of observation is also equal to the largest dimension measured in the plane of observation (that is L) and they are assimilated during counting to spherical particles of diameter L; this causes the average diameter to be overestimated somewhat.

The number of particles per $\mu^3$ is calculated by dividing the number of particles counted in the total field of 400 $\mu m^2$ by the volume of metal examined, thickness of the adjacent blade of 0.12 $\mu$m.

The thermal treatment forming the subject of the present invention and allowing the particles to be distributed as defined above, and the resulting mechanical properties which will be listed below, may be applied according to two variations.

The first variation is preferably applied to thin products, that is to say, in practice, to sheets between 1 and 12.7 mm thick and more particularly, between 1 and 5 mm thick.

This treatment involves carrying out homogenization on the foundry plates for between 4 and 12 hours and, preferably, for about 8 hours at a temperature of between 505° and 535° C., thus above that of the melting point of metastable eutectics. The sheets are subsequently hot-rolled then cold-rolled and they are finally subjected to a conventional solution heat treatment at a temperature below 499° which may be very short and last, for example, between 10 and 20 minutes. They are finally subjected to quenching and tempering in a conventional manner.

The homogenization treatment is carried out without a previous stage at a lower temperature and without the necessity of respecting any rate in the rise of temperature. The momentary appearance of liquid phases which will be reabsorbed later on, is of minor importance. It is sufficient for the hydrogen content merely to be limited to a value below 2 ppm and, preferably, 0.1 ppm and for all precautions to be taken to avoid a partial water vapor pressure which is too high within the furnace.

The second variation is preferably applied to thick sheets, that is to say, in practice to sheets thicker than 8 mm, particularly, thicker than 15 mm.

For this type of product, the treatment forming the subject of the present invention is characterized by the combination of a conventional homogenization treatment, that is to say, at below 477° C., for example, 460° C. The product is subsequently hot-rolled to a final thickness and is then subjected, prior to quenching, to a solution heat treatment, during which the high temperature treatment is carried out. This solution heat treatment is distinguished by two characteristics:

(a) it comprises two stages; one stage at normal temperature for this type of treatment of between 465° and 488° C. for a period of between 15 minutes and 4 hours.

(b) the second stage at high temperature, from 505° to 535° C., for a fairly short period, considering that it constitutes the only stage at high temperature throughout the range of transformation lasting from ½ and hour to 1½ hours. A quenching treatment and tempering completes the range of transformation.

However, in the case of products having no eutectic melting point towards 490° C., the first phase is not essential and it is possible to raise the temperature rapidly to a temperature of between 505° and 535° C..

EXAMPLES

The following examples serve to illustrate the present invention and to clarify the differences from the prior art.

Examples I and II relate to thin sheets while Examples III and IV relate to thick sheets.

EXAMPLE I

Starting from the same batch of two 7475 alloy plates emanating from a same casting, the operations shown in the Table below were carried out:

| | Conventional Range Plate No. 1 | Range according to the invention Plate No. 2 |
|---|---|---|
| Homogenization | 8 h at 460° C. | 8 h at 515° C. |
| Hot-rolling | from 280 mm thickness to 4.5 mm | from 280 mm thickness to 4.5 mm |
| Cold-rolling | from 4.5 mm thickness to 1.6 mm | from 4.5 mm thickness to 1.6 mm |
| Solution heat treatment | 15 min. at 465° C. | 15 min. at 465° C. |
| Quenching | cold water | cold water |
| Tempering | 4 h at 122° C. + 15 h at 162° C. | 4 h at 122° C. + 15 h at 162° C. |

The toughness was evaluated, on the one hand, by the $Re/R_{0.2}$ ratio, the ratio of the breaking strength to the tensile strength of a notched specimen (radius at bottom of notch less than 13$\mu$) to the yield strength at 0.2% elongation and, on the other hand, by the value of the $K_C$ coefficient, critical factor of intensity of stress expressed in megapascal meter. This ratio $Re/R_{0.2}$ which forms the subject of ASTM standard E 338-73 for thin sheets and of a draft ASTM standard for thick sheets (Book of Standards, Part 10, 1974, pages 657–668) is well correlated to the $K_C$ factor.

The results, completed by giving the average phase E particle diameters, are shown in the Table below.

The operating conditions for measuring $K_C$ or $K_{1C}$ are shown by a group of two letters, the first of which designates the direction of the stress and the second of which designates the direction of propagation of the crack, with the following meanings:

| | $Re/R_{0.2}$ | $K_C$ (T − L) | Average particle diameter | Number of particles per $\mu$3 |
|---|---|---|---|---|
| Plate 1 | 0.95 | 128 | 680Å | 168 |
| Plate 2 according to the invention | 0.96 | 137 | 825Å | 70 |

L = long direction
T = long cross direction
S = short cross dirction

EXAMPLE II

Starting from the same batch of two 7475 alloy plates emanating from the same casting as that in Example I, the following operations were carried out:

| | Convntional range Plate No. 3 | Range according to the invention Plate No. 4 |
|---|---|---|
| Homogenization | 8 h at 460° C. | 8 h at 515° C. |
| Hot-rolling | from 280 mm thickness to 7.2 mm | from 280 mm thickness to 7.2 mm |
| Cold-rolling | from 7.2 mm thickness to 4.75 mm | from 7.2 mm thickness to 4.75 mm |
| Solution heat treatment | 26 min. at 465° C. | 26 min. at 465° C. |
| Quenching | cold water | cold water |
| Tempering | 4 h at 122° C. + | 4 h at 122° C. + |

-continued

| | Convntional range Plate No. 3 | Range according to the invention Plate No. 4 |
|---|---|---|
| | 15 h at 162° C. | 15 h at 162° C. |

The results of measurement intended for evaluating the toughness of the alloys tested are shown in the Table below:

| | $Re/R_{0.2}$ | $K_C$ (T − L) | Average particle diameter | Number of particles per μ3 |
|---|---|---|---|---|
| Plate No. 3 | 0.83 | 82.5 | 680Å | 168 |
| Plate No. 4 | 0.94 | 123 | 865Å | 86 |

In each of these two Examples, the highest values of $K_C$ are obtained by the treatment forming the subject of the invention.

EXAMPLE III

Starting from the same batch of three 7475 alloy plates emanating from the same casting, but different from the casting in Examples I and II, the operations shown in diagrammatic form in the Table below were carried out:

| | Conventional range Plate No. 5 | Range according to the invention. 1st variation. Plate 6 | Range according to the invention. 2nd variation. Plate 7 |
|---|---|---|---|
| Homogenization Hot-rolling | 8 h at 460° C. from 280 mm thickness to 16 mm | 8 h at 515° C. from 280 mm thickness to 16 mm | 8 h at 460° C. from 280 mm thickness to 16 mm |
| Solution heat treatment | 3 h at 465° C. | 3 h 482° C. | 3 h at 482° C. + 1 h at 515° C. |
| Quenching | cold water | cold water | cold water |
| Tempering | 5 h at 120° C. + 15 h at 159° C. | 6 h at 105° C. + 24 h at 157° C. | 5 h at 120° C. + 15 h at 159° C. |
| $K_C$, direction L-T | 147 | 165 | 189 |

EXAMPLE IV

Starting from two other plates emanating from the same casting as that in Example III, the operations described in the Table below were carried out:

| | Conventional range Plate No. 8 | Range according to the invention. 2nd variation Plate No. 9 |
|---|---|---|
| Homogenization Hot-rolling | 8 h at 460° C. from 280 mm thickness to 80 mm | 8 h at 460° C. from 280 mm thickness to 60 mm |
| Solution heat treatment | 3 h at 465° C. | 3 h at 482° C. + 1 h at 515° C. |
| Quenching | cold water | cold water |
| Tempering | 6 h at 105° C. + 24 h at 165° C. | 6 h at 105° C. + 24 h at 165° C. |

The measured $K_{1C}$ values in the three directions: L-T, T-L and S-L, as well as the average phase E particle diameter are shown in the Table below:

| | $K_{1C}$ (MPa $\sqrt{m}$) L-T | T-L | S-L | Average particle diameter | Number of particles per μ3 |
|---|---|---|---|---|---|
| Plate No. 8 | 40.5 | 38.9 | 32.6 | 695 Å | 119 |
| Plate No. 9 | 51.7 | 39.3 | 37.3 | 842 Å | 81 |

A significant improvement in the values of $K_{1C}$ or $K_C$ are noted in each of the four Examples. The results obtained on plate number 9 which was subjected to only one hour of treatment at 515° C. are significant.

We claim:

1. A process for obtaining aluminum-based alloy sheets having improved mechanical properties, wherein particles comprising the insoluble phase $Al_{12}Mg_2Cr$ have an average diameter of between about 800° A and about 1000 Å, due to a thermal treatment comprising the successive steps of:

(a) casting a plate having the composition comprising by weight:

| | |
|---|---|
| zinc | 5.2 to 6.2% |
| magnesium | 1.9 to 2.5% |
| copper | 1.2 to 2.9% |
| chromium | 0.18 to 0.25% |
| iron | <0.12% |
| silicon | <0.10% |
| manganese | <0.06% |
| titanium | <0.06% |
| aluminum | balance; |

(b) effecting homogenization of the plate by subjecting the plate to a temperature below about 477° C. which temperature is below the melting point of metastable eutectics for a period of about 4 to about 12 hours;

(c) at least hot rolling; and (d) solution heat treating, quenching and tempering wherein the solution heat treatment is carried out in two stages comprising a first stage at a temperature of between 465° C. and about 485° C. for a period of about 15 minutes to about 4 hours and a second stage at a temperature of between about 505° C. and about 535° C. for a period of about 30 to about 90 minutes.

2. The process according to claim 1 wherein thick sheets of more than about 8 mm thickness are produced.

* * * * *